US008193710B2

(12) United States Patent
Muraki et al.

(10) Patent No.: US 8,193,710 B2
(45) Date of Patent: Jun. 5, 2012

(54) LAMP WITH AT LEAST ONE BASE

(75) Inventors: Shinobu Muraki, Kanzaki-gun (JP); Satoshi Ono, Kanzaki-gun (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/853,421

(22) Filed: Aug. 10, 2010

(65) Prior Publication Data

US 2011/0043109 A1 Feb. 24, 2011

(30) Foreign Application Priority Data

Aug. 19, 2009 (JP) ..... 2009-189679

(51) Int. Cl.
*H01J 17/18* (2006.01)

(52) U.S. Cl. ..... 313/623

(58) Field of Classification Search ..... 313/623–625
See application file for complete search history.

(56) References Cited

U.S. PATENT DOCUMENTS

| | | | | |
|---|---|---|---|---|
| 4,970,425 | A * | 11/1990 | Barakitis | 313/39 |
| 5,310,374 | A * | 5/1994 | Tomoyuki | 445/27 |
| 6,384,533 | B1 * | 5/2002 | Giesel et al. | 313/623 |
| 7,019,462 | B2 * | 3/2006 | Okamoto et al. | 313/634 |
| 7,095,175 | B2 | 8/2006 | Kai et al. | |
| 2002/0063529 | A1 * | 5/2002 | Fukai et al. | 313/623 |
| 2004/0201352 | A1 * | 10/2004 | Okamoto et al. | 313/623 |
| 2006/0232211 | A1 | 10/2006 | Welters et al. | |

* cited by examiner

*Primary Examiner* — Peter Macchiarolo
(74) *Attorney, Agent, or Firm* — Roberts Mlotkowski Safran & Cole, P.C.; David S. Safran

(57) ABSTRACT

A lamp with a light emission element arranged in a light-emitting tube, external leads for supplying energy to the light emission element, an antioxidant layer covering said external leads, sealing portions sealing metal foils connected electrically to the external leads and a base fixed via an adhesive to said sealing portions. The adhesive that fixes the base does not directly contact the antioxidant layer since an intermediate layer made of a material which does not react with the alkali in the adhesive is provided at a periphery of the antioxidant layer of the external lead, and the base is fixed by the adhesive being provided at an outer periphery of the intermediate layer.

5 Claims, 4 Drawing Sheets

LAMP WITH AT LEAST ONE BASE

BACKGROUND OF THE INVENTION

1. Field of Invention

This invention relates to a lamp with at least one base, and relates especially to a lamp with at least one base wherein the base is fixed by means of an adhesive to a sealing portion sealing an external lead which supplies energy to a light emission element in a light-emitting tube.

2. Description of Related Art

To prevent that the external lead supplying energy to the light emission element arranged in the light-emitting tube reaches a high temperature in the condition of being exposed to the outside air and oxidizes, hitherto the periphery was covered with an antioxidant layer. Japanese Patent Application Publication JP-A-2006-525637 and corresponding U.S Patent Application Publication 2006/0232211 A1 and Japanese Patent Application Publication JP-A-2004-139959 and corresponding U.S. Pat. No. 7,095,175 B2 disclose such means.

In FIG. 5, the respective schematical configuration is shown. In this drawing, a filament lamp is shown. In a light-emitting tube 2 of this lamp 1, a filament 3 is arranged as the light emission element. Both ends of this element are connected via internal leads 5 to metal foils 6. External leads 7 are connected to the metal foils 6, and said light emission element (filament) 3 is supplied with energy via the external leads 7. The internal leads 5, the metal foils 6 and the external leads 7 are sealed by sealing portions 4.

Further, the periphery of the external leads 7 is covered by an antioxidant layer 8, by means of which an oxidation of the external lead 7 is prevented. For this antioxidant layer, a material with a lower oxidation potential than that of the material constituting the external lead is chosen. If, for example, the external material is formed by molybdenum, the antioxidant layer is made, for example, from tin, lead, copper, silver, cadmium, platinum or gold.

By means of covering the outer surface of the external lead with an antioxidant layer, the antioxidant layer becomes exposed to the outside air and the antioxidant layer oxidizes beforehand. But, because the antioxidant layer is constituted by a material with a lower oxidation potential than that of the material of the external lead, the corrosion speed of the oxidation is lower than that of the external lead and the expansion of the volume with regard to the elapsed time is smaller as compared to an oxidation of the external lead. Therefore, the antioxidant layer covering the external lead is effective in suppressing cracks of the sealing portion.

But, when this kind of lamp is mounted in a lighting tool, a base is mounted to the sealing portion, and in general, the base is fixed to the sealing portion by using an adhesive. In FIG. 6, this configuration is shown. An antioxidant layer 8 is applied to the external lead 7, and a terminal 12 is mounted at the outer end of the lead. Further, a base 10 is fixed to the sealing portion 4 by means of an adhesive 11. That is, the adhesive 11 is filled into the base 10 containing the outer periphery of the external lead 7, and this base 10 is fixed to the sealing portion. For the adhesive 11, an inorganic adhesive (the components of which being, for example, 49% $Al_2O_3$, at most 1% $LiO_2$, at most 1% $Na_2O$, 31% $SiO_2$, and $H_2O$ forming the rest) is used.

With lamps having such a configuration with at least one base, it is frequently observed that the time until cracks are generated in the sealing portion is shorter in comparison to lamps with a structure having no base. As to the cause of this phenomenon, the present inventors have found out in experiments that in the condition of the adhesive contacting the external lead, the alkali (Li, Na) contained in the adhesive reacts with the antioxidant layer at the outer surface of the external lead and corrodes the antioxidant layer so that the ability of the antioxidant layer to suppress an oxidation is decreased. When the ability of the antioxidant layer to suppress the oxidation is decreased, the oxidation of the external lead is promoted and the external lead expands. When the external lead embedded in the sealing portion expands, the sealing portion is pressed by the expanding external lead and cracks are generated which often entail breakages.

SUMMARY OF THE INVENTION

The object of the present invention is to provide a configuration for a lamp with at least one base being provided with a light emission element arranged in a light-emitting tube, external leads supplying energy to said light emission element, an antioxidant layer covering said external leads, sealing portions sealing metal foils connected electrically to said external leads, and bases fixed via an adhesive to said sealing portions, wherein said antioxidant layer is not corroded by the adhesive fixing said bases and the antioxidation effect is not affected.

To solve the above mentioned problem, the lamp with at least one base of this invention is characterized in that the adhesive fixing the base to the sealing portion does not directly contact the antioxidant layer applied to the external lead.

Additionally, it is characterized in that said adhesive is provided only between the base and the sealing portion and there is no contact with the antioxidant layer.

Further, it is characterized in that an intermediate layer made of a material that is not reactive with the alkali in the adhesive is provided at the periphery of the antioxidant layer of the external lead, and said base is fixed by arranging said adhesive at the outer periphery of said intermediate layer.

According to this invention, the adhesive fixing the base to the sealing portion does not directly contact the antioxidant layer applied to the external lead, so that there is no corrosion of the antioxidant layer by the alkali in the adhesive and there is no risk that the antioxidation effect is produced. As a result, no defects, such as cracks of the sealing portion or breakages by means of an oxidation of the external lead, are caused.

DETAILED DESCRIPTION OF THE INVENTION

Figure 1:
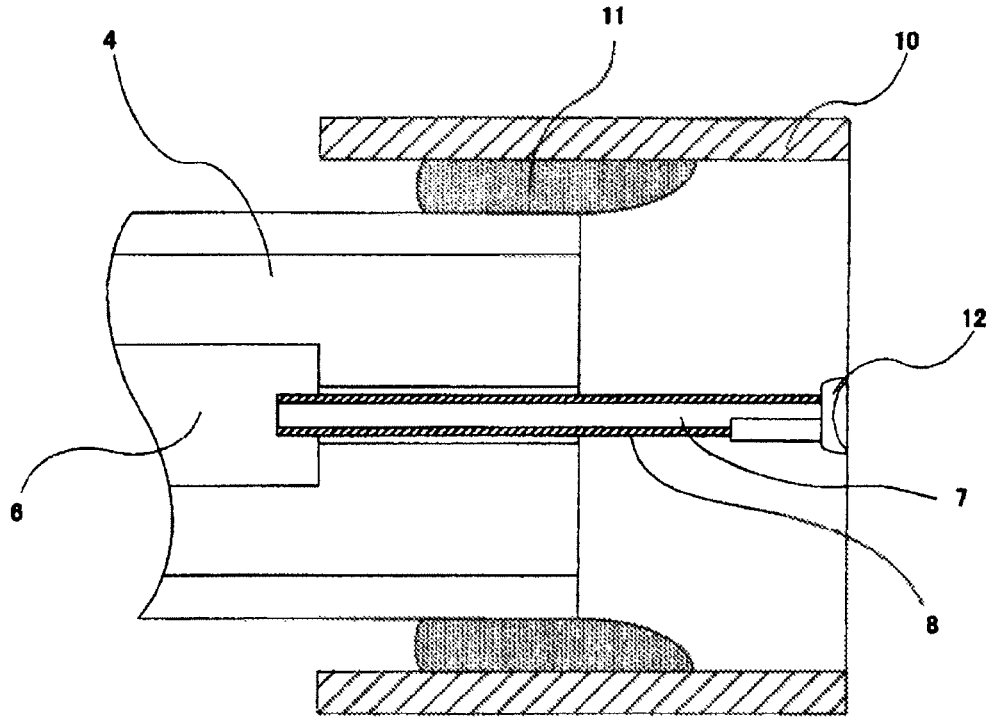
FIG. 1 is a schematic partial sectional view of a lamp with at least one base of the present invention.

FIG. 1 is a partial sectional view of a lamp with at least one base according to this invention.

A base 10 is fixed by an adhesive 11 to a sealing portion 4. Said adhesive 11 is provided only between the sealing portion 4 and the base 10 and is not present at the periphery of the external lead 7. That is, it does not directly contact the antioxidant layer 8 applied to the external lead 7.

Figure 6:
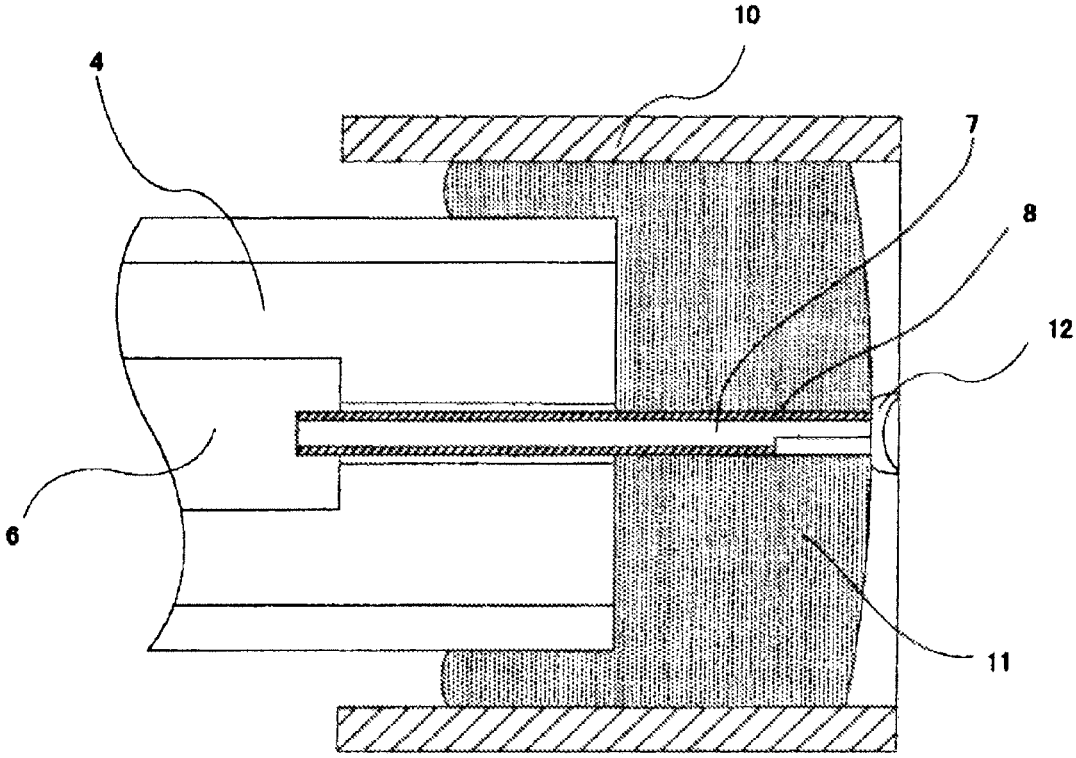
Fig. 6 (Prior Art)
FIG. 6 is a schematic partial sectional view of the conventional example.

The other reference numerals indicate the same elements as the elements indicated respectively by the same reference numerals shown in FIG. 6.

Figure 2:
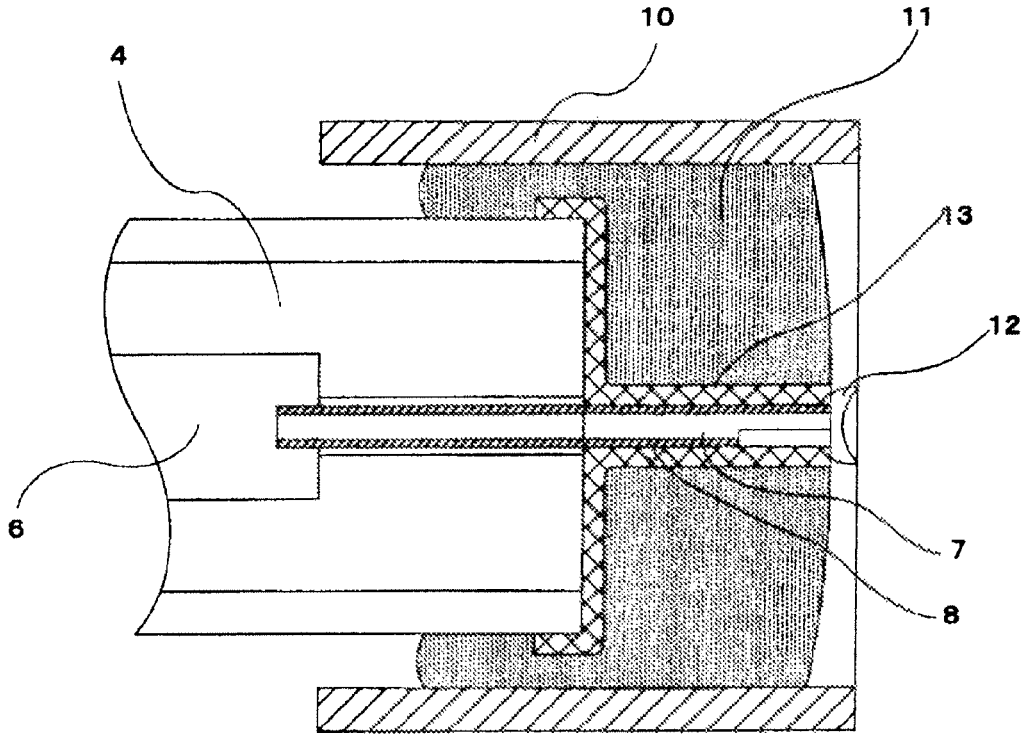
FIG. 2 is a schematic partial sectional view of another embodiment of a lamp with at least one base of the present invention.

FIG. 2 is another embodiment of this invention. At the periphery of the antioxidant layer 8 of the external lead 7 an intermediate layer 13 is provided which is made from a material which does not react with the alkali in the adhesive 11. This intermediate layer 13 is, for example, formed by applying a tube from, e.g., glass or carbon to the external lead 7 or can be made by winding a tape from glass or carbon. The adhesive 11 is provided in the base 10 at the periphery of said intermediate layer 13. In the same drawing, the intermediate layer 13 is provided such that it is applied up to the end part of the sealing portion 4, but such a provision is not necessarily required, and it is also possible to provide it only at the outer periphery of the antioxidant layer 8 of the external lead 7.

If the fixing of the base 10 to the sealing portion 4 can be ensured sufficiently according to the shape and the size of the lamp, it is possible to use the mounting structure of FIG. 1, but if an even stronger fixing is demanded, the mounting structure of FIG. 2 can be used. In the above embodiments double-end filament lamps are shown, but an application to other types of lamps is also possible.

Figure 3:
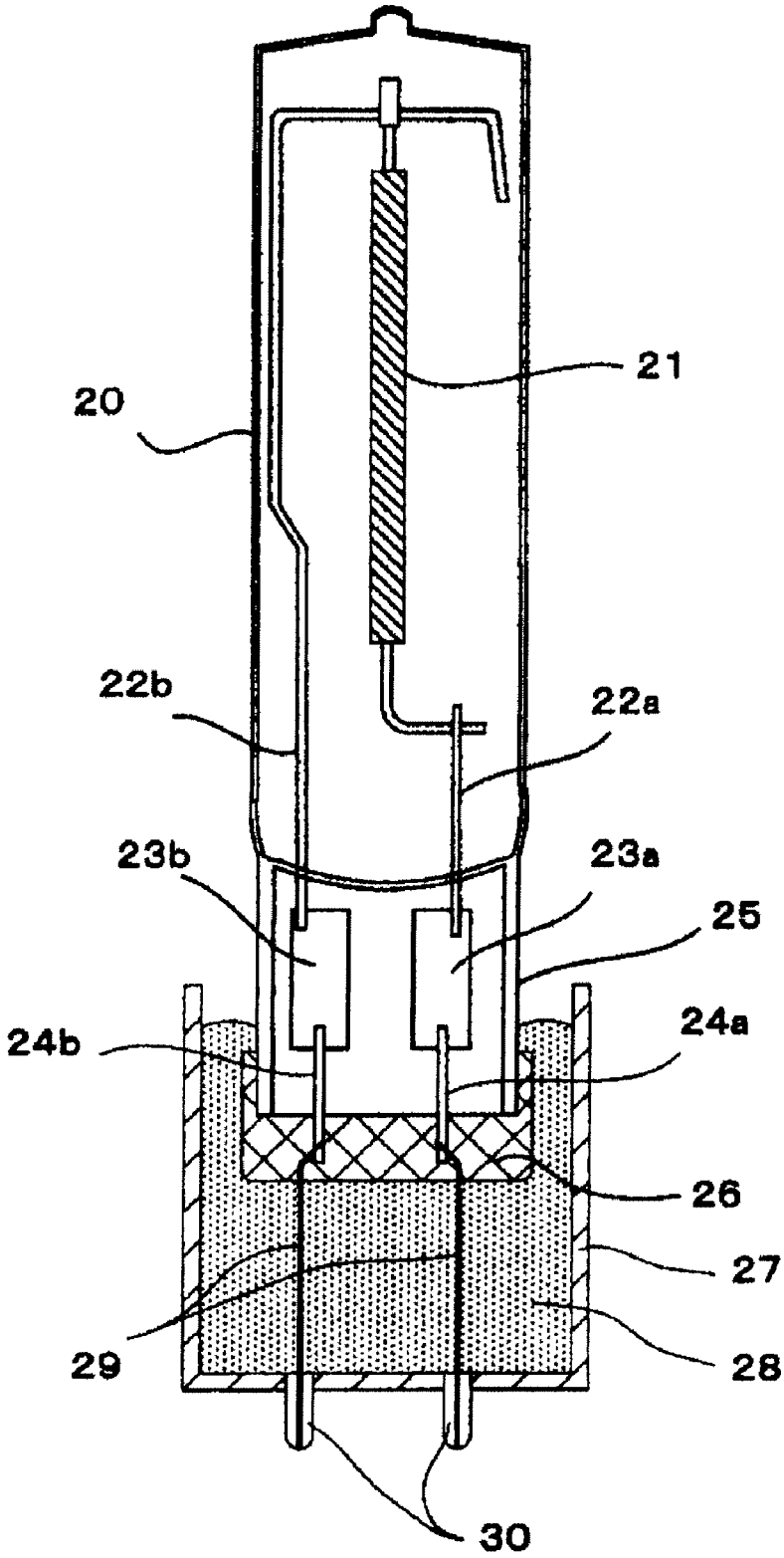
FIG. 3 is another practical example.

In FIG. 3, a single-end filament lamp is shown. In this drawing both ends of a filament 21 arranged in a light-emitting tube 20 are connected to internal leads 22*a*, 22*b*, and these internal leads 22*a*, 22*b* are connected to external leads 24*a*, 24*b* via metal foils 23*a*, 23*b*. Although the respective depiction is omitted, the same antioxidant layer as in FIG. 1 and FIG. 2 is applied to these external leads 24*a*, 24*b*. The external leads 24*a*, 24*b* are covered by a glass tube 26 and a base 27 is fixed by an adhesive 28 to a sealing portion 25. 29 indicates a fuse wire, and 30 indicates terminals.

Figure 4:
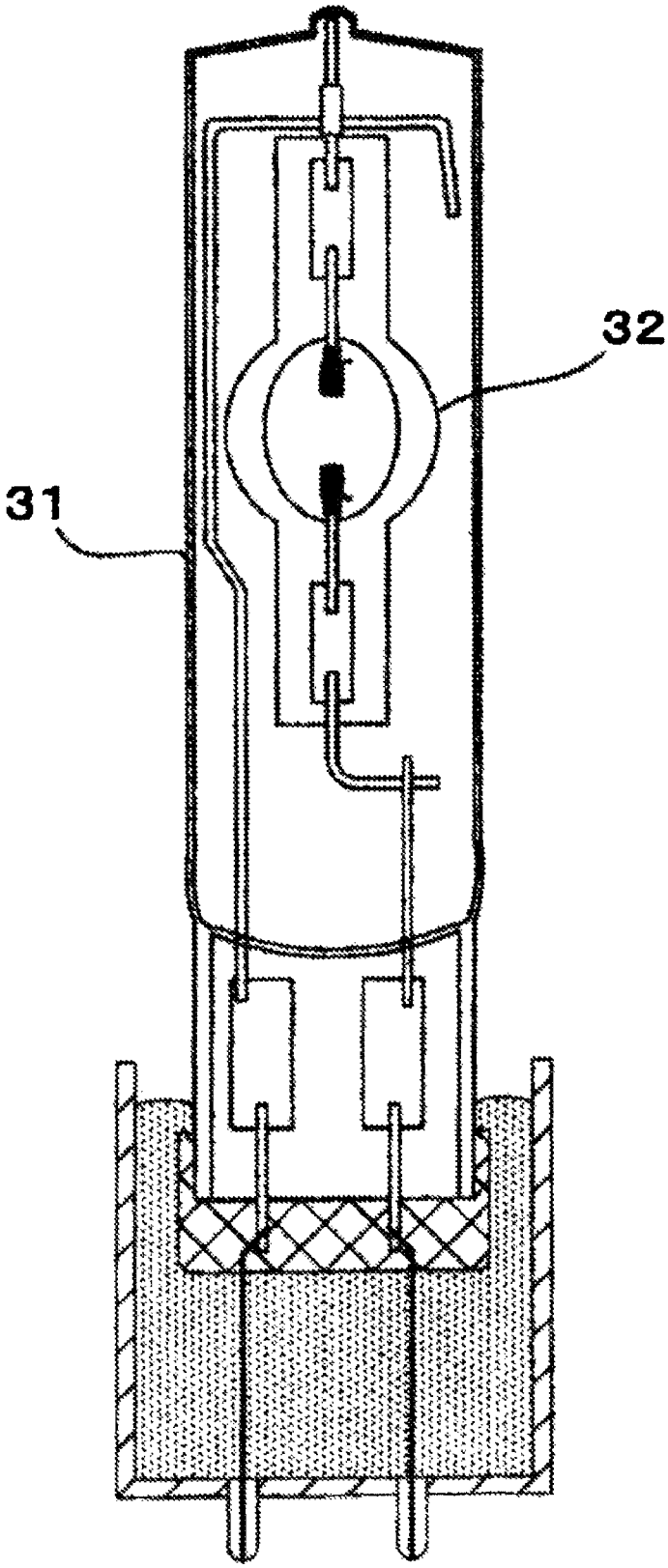
FIG. 4 is still another practical example.
Figure 5:
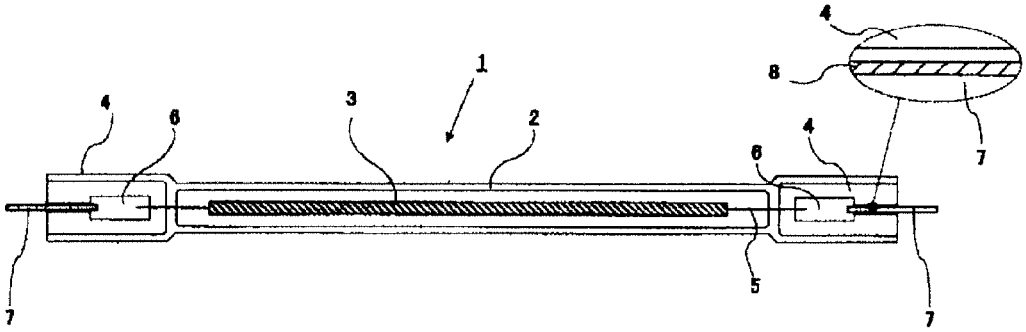
Fig. 5 (Prior Art)
FIG. 5 is a schematic sectional view of a conventional example.

FIG. 4 is still another practical example wherein a discharge tube 32 as a light emission element is arranged in the interior of a light-emitting tube 31. The remaining configuration is similar to the example of FIG. 3.

In the above mentioned practical examples presented in FIGS. 3 and 4, configurations are shown in which the external leads 24 are covered by an intermediate layer 26 and an adhesive 28 is filled into the base 27, but as a matter of course also configurations in which the adhesive 28 is only provided between the base 27 and the sealing portion 25 and there is no direct contact between the adhesive and the antioxidant layer of the external leads can be devised.

In the following, test results showing the effects of the present invention are presented. For the test, a lamp (A) with the configuration of FIG. 1 and a lamp (B) with the configuration of FIG. 2 were used as lamps of the present invention, and a lamp (C) shown in FIG. 6 was used as a comparison example. The specifications of these lamps were as follows:

Coil length of filament: 65 mm;

Diameter of light-emitting tube: 13 mm;

Overall length of light-emitting tube: 118 mm;

Antioxidant layer: 1 mol/l of an aqueous solution of silver nitrate was applied to the external leads and dried at 80° C.;

Adhesive: 49% $Al_2O_3$, at most 1% $LiO_2$, at most 1% $Na_2O$, 31% $SiO_2$, rest $H_2O$.

The lighting conditions were as follows:

Lighting tool: device for photography, 1 kW×6 lamps;

Lighting conditions: 100 V·1 kW.

The lighting was performed under the above mentioned conditions and the time until the breakage of the sealing portion was observed in units of 10 hours.

By means of this lighting tool, at the time of the lighting of the lamps a temperature environment of 480 to 500° C. was generated and each lamp was lighted continuously in this temperature environment.

The results of the above mentioned test are summarized in table 1.

TABLE 1

| | Conventional example (FIG. 6) | Present invention (A) (FIG. 1) | Present invention (B) (FIG. 2) |
|---|---|---|---|
| Time until breakage of the sealing portion | 120 hours (breakage) | at least 240 hours (without breakage) | at least 240 hours (without breakage) |

As to the above mentioned mounting of the base to the sealing portion, when the adhesive was provided such that it covered the external lead having been covered by an antioxidant layer, as was shown in the comparison example (conventional example), cracks were generated and a breakage occurred in a short time (120 hours) as compared to the present invention. With the configurations (A) and (B) of the present invention on the other hand, neither cracks nor breakages were observed even after 240 hours had elapsed so that a significant improvement with regard to the life cycle can be expected.

Since, as was mentioned above, according to the present invention the antioxidant layer is not corroded by the alkali component in the adhesive and the antioxidation effect is not affected due to a configuration in which there is no direct contact between the adhesive mounting the base to the sealing portion and the antioxidant layer of the external lead, there is no generation of cracks or breakages in the sealing portion and the life cycle can be prolonged.

What is claimed is:

1. Lamp with at least one base, comprising a light emission element arranged in a light-emitting tube, external leads supplying energy to said light emission element, an antioxidant layer covering said external leads, sealing portions sealing metal foils connected electrically to said external leads and a base fixed via an adhesive containing alkali to said sealing portions, wherein the adhesive fixing said base does not directly contact said antioxidant layer, wherein an intermediate layer made of a material which does not react with the alkali in said adhesive is provided at a periphery of the antioxidant layer covering the external leads, and wherein said base is fixed by said adhesive to an outer periphery of the intermediate layer.

2. Lamp with at least one base according to claim 1, wherein said light emission element comprises a filament.

3. Lamp with at least one base according to claim 1, wherein said light emission element comprises a discharge tube.

4. Lamp with at least one base according to claim 1, wherein said intermediate layer comprises a glass tube.

5. Lamp with at least one base according to claim 1, wherein said intermediate layer comprises a carbon tube.

* * * * *